US007739808B2

(12) United States Patent
Cotton

(10) Patent No.: US 7,739,808 B2
(45) Date of Patent: Jun. 22, 2010

(54) GENIE DISPOSABLE SLIPPER

(76) Inventor: Sawsan Sharaf Cotton, 3016 Gannon Ridge Ave., Las Vegas, NV (US) 89081

( * ) Notice: Subject to any disclaimer, the term of this patent is extended or adjusted under 35 U.S.C. 154(b) by 385 days.

(21) Appl. No.: 11/821,756

(22) Filed: Jun. 25, 2007

(65) Prior Publication Data

US 2008/0000105 A1 Jan. 3, 2008

Related U.S. Application Data

(60) Provisional application No. 60/817,050, filed on Jun. 29, 2006.

(51) Int. Cl.
*A43B 3/12* (2006.01)

(52) U.S. Cl. ..... 36/11.5; 36/8.4

(58) Field of Classification Search ..... 36/11.5, 36/8.4, 9 R, 9 A, 94, 31, 71; D2/917
See application file for complete search history.

(56) References Cited

U.S. PATENT DOCUMENTS 4,030,212 A * 6/1977 Ito ..... 36/11.5
4,477,985 A * 10/1984 Yuan-Hsiang ..... 36/11.5
5,615,496 A * 4/1997 Sharpstein ..... 36/11.5
5,737,853 A * 4/1998 Smejkal ..... 36/11.5
5,870,837 A * 2/1999 Poulos ..... 36/11.5
5,946,823 A * 9/1999 Yates ..... 36/11.5
D420,785 S * 2/2000 Perez ..... D2/916
6,116,253 A * 9/2000 Armstrong ..... 132/333
D433,555 S * 11/2000 Lu ..... D2/916
6,226,893 B1 * 5/2001 Schlamp et al. ..... 36/11.5
6,298,580 B1 * 10/2001 Tadayon ..... 36/11.5
6,526,676 B1 * 3/2003 Ledergerber ..... 36/11.5
6,625,904 B1 * 9/2003 Frederiksen et al. ..... 36/11.5
D481,828 S * 11/2003 Goldberg et al. ..... D28/56
6,678,971 B2 * 1/2004 Brooks ..... 36/94
6,792,697 B2 * 9/2004 Wright et al. ..... 36/11.5

* cited by examiner

*Primary Examiner*—Jila M Mohandesi

(57) ABSTRACT

The Genie disposable pedicure slipper is formed from a single piece of material that consist of polyurethane foam fabric. The pedicure slipper is intended to be worn as slipper on the users foot. The sole of the slipper is designed to conform to the outline of the human foot. The bottom surface structure is designed to give support, comfort and rest for the users foot. There are two strap portions of the sheet material. One of the strap portions comes from the heel of the sole and is cut to form an appendage. The other strap portion comes from the toe of the sole and has a slit. The two straps when folded over serve as a buckle by inserting the appendage into the slit.

2 Claims, 3 Drawing Sheets

GENIE DISPOSABLE SLIPPER

CROSS-REFERENCE TO RELATED APPLICATIONS

This application claims benefit of U.S. Provisional application No. 60/817,050, filed Jun. 29,2006.

STATEMENT REGARDING FEDERALLY SPONSORED RESEARCH OR DEVELOPMENT

"Not Applicable"

REFERENCE TO SEQUENCE LISTING, A TABLE, OR COMPUTER PROGRAM LISTING COMPACT DISC APPENDIX

"Not Applicable"

FIELD OF INVENTION

The invention relates in general to the field of disposable footwear. More particularly, the invention relates to a disposable slipper made from a single die-cut piece of sheet material.

BACKGROUND OF THE INVENTION

There are times when the use of temporary footwear is desired. A few examples of locations where temporary footwear may be utilized are at, spas, hotels, health clubs, doctors offices, hospitals, and pedicure salons. Conventional footwear can be used on a temporary basis. Furthermore, reusable footwear raises concerns about hygiene. Therefore a disposable footwear product is preferred for temporary use.

U.S. Pat. No. 62,985,580, discloses a slipper to be worn during pedicure. The slipper in patent 629 has significant limitations, first, there is only one strap to keep the foot from slipping out of the slipper making difficult for the user to keep the slipper on. Second it does not allow the wearer the opportunity to be mobile due to the one strap that doesn't fasten tightly to the users foot. Lastly, the slipper is cost prohibitive to manufacture as a disposable article.

U.S. Pat. No. 6,226,983, discloses a slipper to be worn during pedicure. The slipper in patent 622 has significant limitations, first, it spaces apart the toes to an extent of discomfort. Second, it is very puzzling and sophisticated to use and wear. Lastly, it doesn't secure the feet to the slipper making it difficult to be mobile.

U.S. Pat. No. 5,870,837, discloses a slipper to be worn during pedicure. The slipper in patent 580 has significant limitations, first, the slipper has a puzzling structure that requires the toes of the user to be spaced in difficult positions. Second, it also doesn't support the user foot making the slipper uncomfortable for the user to wear. Lastly, the slipper is cost prohibitive to manufacture as a disposable article.

Furthermore each of the disclosed assembly suffers from one or more of the aforementioned limitations. There is a well-established need for a comfortable mobile pedicure slipper wearable during and after the performance of a pedicure.

BRIEF SUMMARY OF THE INVENTION

The present invention provides a disposable slipper which is formed from a single piece of material consisting of polyurethane foam. The sole of the slipper is shaped to generally conform to the outline of the human foot. The strap portion comes from the heel of the sole of the slipper and at the end of the strap is an appendage. The other strap portion comes from the toe of the sole of the slipper and has a slit at its end. Both strap portions when folded over serve as a buckle by inserting the appendage into the slit.

The object of the disposable slipper is to provide a pedicure slipper having improved utility both for purpose of pedicure within a salon, hospital, spa, hotel and use in an ordinary or conventional manner.

Its another object of the disposable slipper is it allows enhanced comfort and stabilization of the foot and toes.

It is a further object of the disposable slipper is to provide sufficient separation between toes.

It is a further object of the disposable slipper it can be worn and removed without any damage to nail polish.

It is a further object of the disposable slipper to allow the user the mobility to move freely with in the salon or outside of the salon before and after applying polish to the toes.

It is still another object of the toe separator has a construction conducive to its cost effective manufacture as a disposable article.

DETAILED DESCRIPTION OF THE INVENTION

Figure 1:
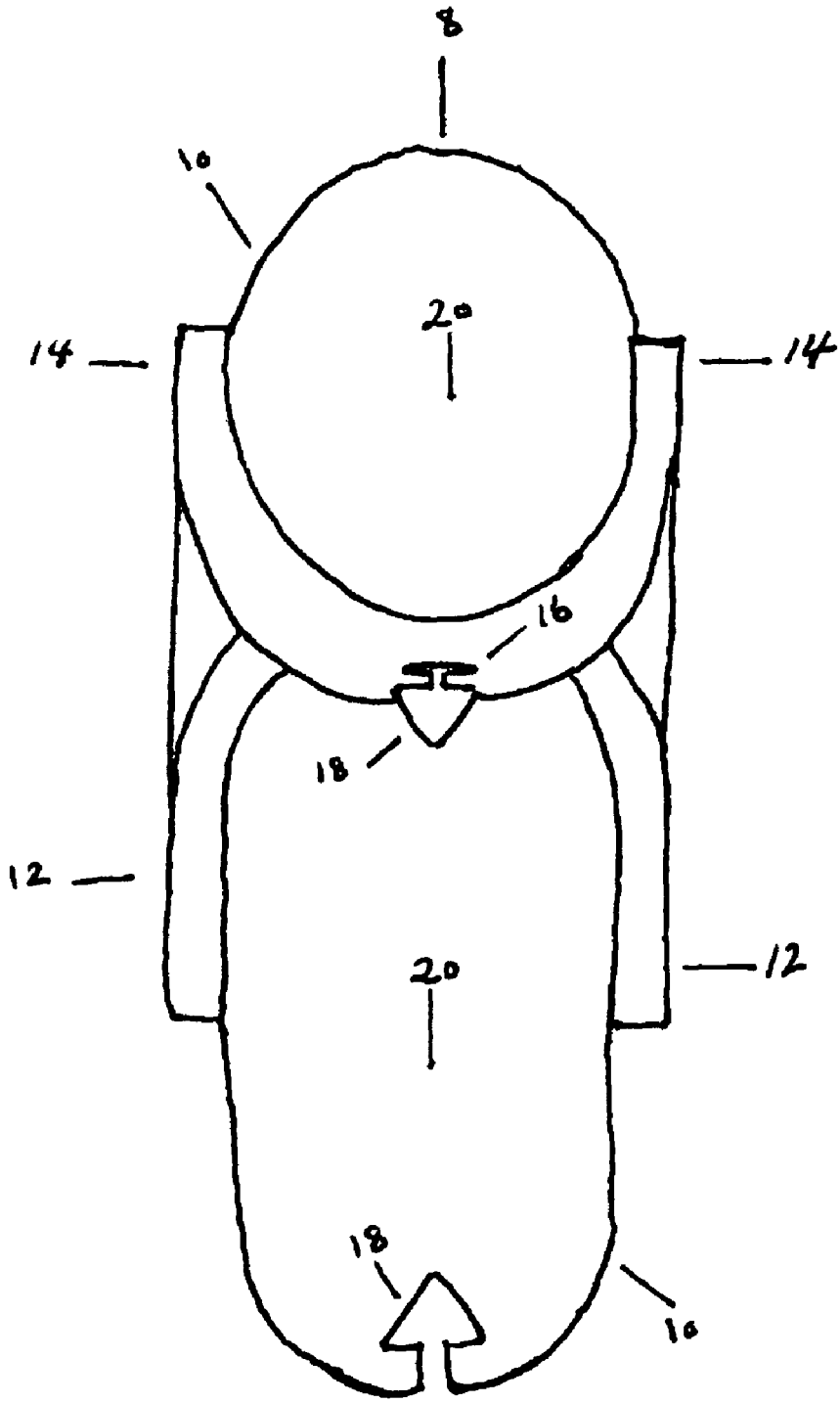
FIG. 1 is a perspective view of the pedicure slipper constructed in accordance to the present invention.

FIG. 1 illustrates a pedicure slipper 8 constructed in accordance with the present invention. The slipper generally comprises a sole portion 10 and the heal strap portion 12 and the toe strap portion 14. The strap portion 12 is formed as a hand of the sheet material surrounding the heal of the sole. And the strap portion 14 is formed as a hand of the sheet material surrounding the toe of the sole. The strap portion 12 is formed as a band of the sheet material surrounding the heal and has a cut out 18 of an appendage on the end of the curved strap. The strap portion 14 that is formed as a band of the sheet material surrounding the sole and has a slit 16 on the end of the curved strap. When the straps portions 12 and 14 are folded over they serve as a buckle by inserting the appendage 18 on the heel strap into the slit 16 on the sole strap.

Figure 2:
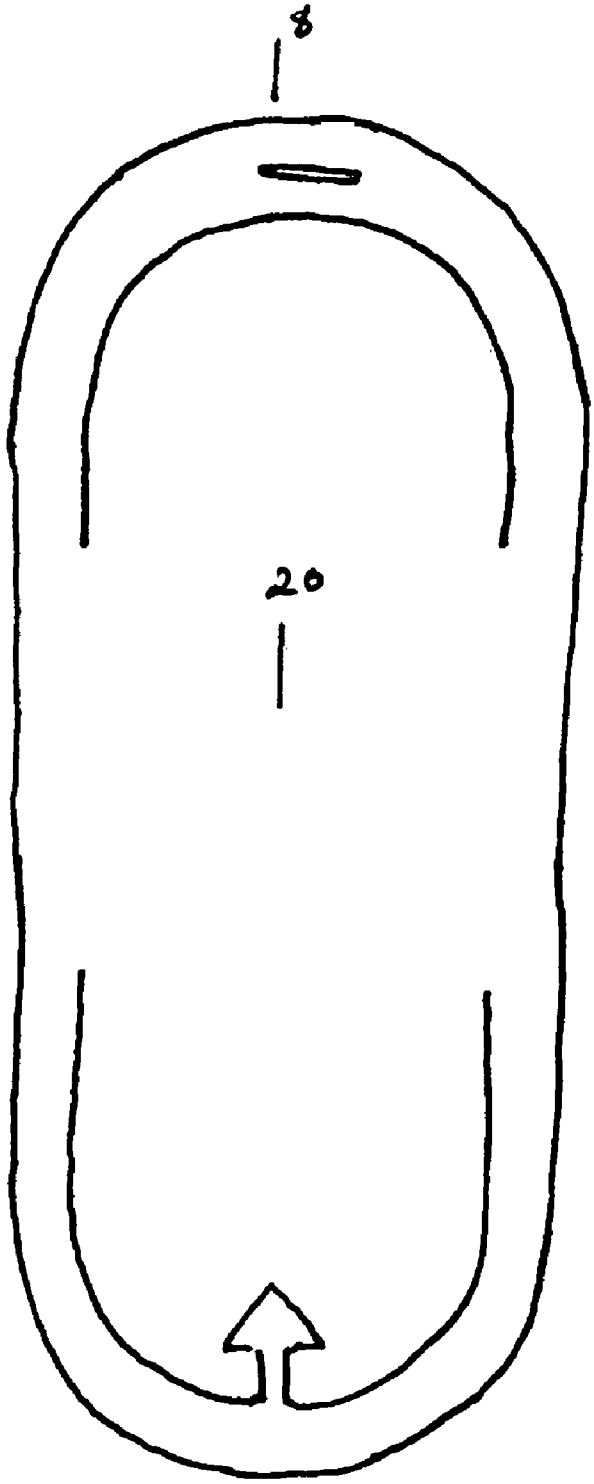
FIG. 2 is the top plan view of the pedicure slipper shown in FIG. 1.

FIG. 2 illustrates the top plan view of the pedicure slipper 8. The view is comprised of the bottom sole portion 10 of the pedicure slipper. The top surface structure 20 of the slipper is deigned to support the foot of the user. The straps of the slipper 12 and 14 are visible on the top plan surface of the slipper 20. The cut out appendage 18 and the slit 16 on the strap portions 12 and 14 are also visible when folded over and buckled from the top surface structure 20.

Figure 3:
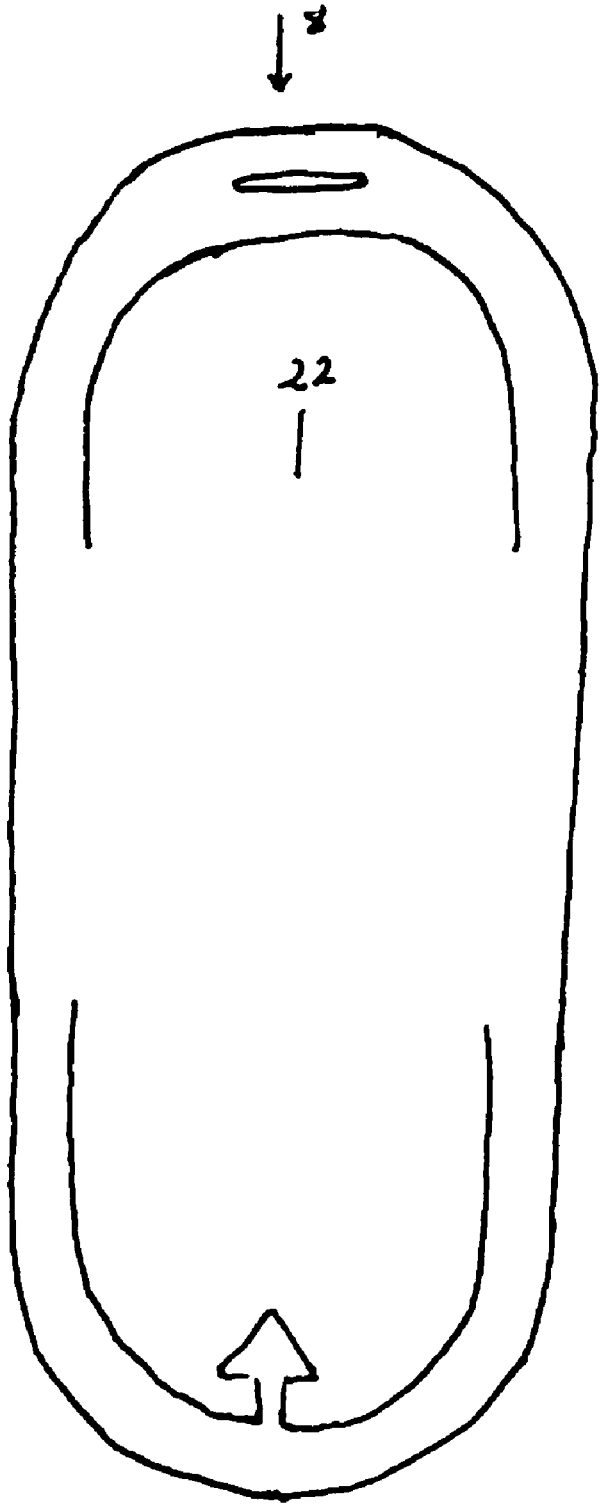
FIG. 3 is the bottom plan view of the pedicure slipper shown in FIG. 1.

FIG. 3 illustrates the bottom plan view of the pedicure slipper 8. The view is comprised of the bottom sole portion 10 of the pedicure slipper. The bottom surface structure 22 is the surface that is aligned to the ground and provides stability for the user when mobile.

What I claim as my invention is:

1. A disposable slipper comprising: a single piece of sheet material having sole portion in the general outline of a human foot defining a toe portion and a heel portion, said sole portion comprising an initially flexible planar member having the configuration of a shoe sole; including elongated slits in respectively the heel portion and toe portions of said shoe sole forming a strip element at said heel portion and a strip element at said toe portion each having the ends thereof connected to said shoe sole, said strip element at the heel portion having an appendage which is formed from a cutout in the heel portion and said strip in the toe portion having a slit formed therein, whereby upon said heel strip element being bent upwardly and forwardly above said shoe sole, said toe strip element is bent upwardly and over the heel strip and the slit in the toe strip engages with said appendage of the heel strip to form a thong-like slipper.

2. A disposable slipper according to claim 1, wherein said shoe sole is made from polyurethane foam.

* * * * *